United States Patent [19]

Toyoshima et al.

[11] 4,085,760

[45] Apr. 25, 1978

[54] TOBACCO FILTER

[75] Inventors: Iwao Toyoshima, Tondabayashi; Kunio Ishii, Himeji; Hideo Sawada, Osaka; Junji Kawamoto, Sakai; Hiromu Yokota, Himeji, all of Japan

[73] Assignee: Daicel Ltd., Sakai, Japan

[21] Appl. No.: 722,131

[22] Filed: Sep. 10, 1976

[30] Foreign Application Priority Data

Sep. 19, 1975 Japan ..... 50-113222
Dec. 12, 1975 Japan ..... 50-148299

[51] Int. Cl.[2] ..... A24B 15/027
[52] U.S. Cl. ..... 131/268

[58] Field of Search ..... 131/10 R, 10.5, 10.3, 131/10.7, 10.9, 11, 9, 261 R, 266, 267, 268; 106/167, 169; 117/4

[56] References Cited

U.S. PATENT DOCUMENTS 3,451,887 6/1969 Touey et al. ..... 131/267 UX
3,470,008 9/1969 Watson ..... 131/267 UX

*Primary Examiner*—Robert W. Michell
*Assistant Examiner*—V. Millin
*Attorney, Agent, or Firm*—Blanchard, Flynn, Thiel, Boutell & Tanis

[57] ABSTRACT

A tobacco filter comprised of cellulose acetate fibers prepared by contacting cellulose fibers in the solid fiberous state, with a gaseous or liquid acetylating agent.

8 Claims, No Drawings

TOBACCO FILTER

BACKGROUND OF THE INVENTION

1. Field of the Invention

This invention relates to a tobacco filter comprising a fiber aggregate, at least one component of which is cellulose acetate fiber which is obtained by acetylating cellulose fiber from any one of a variety of sources such as pulp, cotton, jute, viscose rayon, copper-ammonia rayon and the like, while maintaining its fibrous state.

This invention relates more particularly to a tobacco filter comprising a fiber aggregate of a fibrous cellulose acetate fiber having an average degree of acetylation (percent of combined acetic acid) of 10 to 50 percent.

2. Description of the Prior Art

There have been proposed a variety of tobacco filters. One uses a tow of cellulose acetate fiber obtained by acetylating a cellulose raw material in a homogeneous liquid phase and spinning the resulting product to form the fiber. Another uses a tow of a viscose rayon fiber or a polypropylene fiber. Still another employs a non-woven sheet of a fiber such as pulp, viscose rayon, copper-ammonia rayon, polyvinyl alcohol, polyamides and polyolefins, or uses crepe paper.

Of these, there are commercially used filters prepared from a tow of a cellulose acetate fiber obtained by acetylation of cellulose in the homogeneous liquid phase and then spinning the cellulose acetate into fibers, filters from a non-woven fabric of pulp and from crepe paper.

The most popular fiber now in use is prepared in the following manner (as disclosed in, for example, Japanese Patent Publications Nos. 5749/59 and 5750/59). According to this method, the starting cellulose material is first acetylated in the homogeneous liquid phase and is subjected to partial saponification so as to have an acetylation degree (percent of combined acetic acid) of 51 to 56%. The flakes of the resulting cellulose acetate are then dissolved in acetone to form a spinning dope, which is subsequently subjected to dry spinning to form a tow of cellulose acetate. After the addition of a plasticizer, the tow is shaped into a filter in accordance with the known method in the art. (Hereinafter the cellulose acetate filter prepared by this method is referred to as the "homogeneous cellulose acetate filter").

The term "acetylation in a homogeneous liquid phase" used herein refers to an acetylation reaction of cellulose by the use of acetic anhydride which is employed nowadays on an industrial scale for the production of cellulose acetate fiber. During the initial stage, this reaction is carried out in a solid-liquid heterogeneous phase. Because the reaction product is soluble in the reaction solvent used, however, the reaction product is obtained in the homogeneous liquid phase at the end of the reaction. Hence, this term is hereby used specifically in order to distinguish from the heterogeneous system reaction as will be explained hereinafter in this specification for the illustration of the present invention wherein the starting material retains its original shape from the beginning until the end of the reaction and the reaction product is obtained in solid form.

The above mentioned production method for producing the homogeneous cellulose acetate filter requires an extremely long production time from the start until the final product is obtained. For the production of a filter having an especially high filtering efficiency, the preparation of fiber having a fine denier requires a high level of technical skill, thereby resulting in an increased overall cost of production.

In comparison with the above-mentioned homogeneous cellulose acetate filter, the filter from a pulp fiber sheet (such as disclosed in Japanese Pat. Publications No. 2039/70 and 10599/70) and the filter from crepe paper (such as disclosed in Japanese Patent Publication No. 5206/59) are inferior because they deteriorate the flavor and taste of the tobacco in addition to various other defects such as poor roundness of the filter, inferior shape of the cut mouthpiece, deformation of the mouthpiece due to moisture absorption during smoking and so forth.

SUMMARY OF THE INVENTION

We have discovered a tobacco filter which eliminates the above-mentioned problems of the conventional filters and which can be produced economically. The tobacco filter is made of a fibrous cellulose acetate fiber prepared by acetylating cellulose in a heterogeneous phase (gas-solid or liquid-solid) while maintaining the cellulose in its solid fiber state. The tobacco filter comprising a fiber aggregate containing the above-mentioned fibrous cellulose acetate fiber provides excellent filtering characteristics even when only a small quantity is used to make the tobacco filter and yet the original flavor and taste of the tobacco are not spoiled.

The tobacco filter in accordance with the present invention can be prepared from either the fibrous cellulose acetate fiber alone or from a composition containing the fibrous cellulose acetate fiber as one component in an amount of at least 30 weight percent, in combination with various different cellulosic fiber materials such as pulp, cotton, jute, viscose rayon, copper-ammonia rayon and proper amounts of other natural or synthetic fiber materials.

Various methods of acetylation can be used for preparing the fibrous cellulose acetate fiber used in the present invention, so long as the methods ensure that the starting cellulose material retains its fiber state during the reaction.

The type of starting cellulose material used is not critical. Examples thereof include pulp, cotton, viscose rayon, copper-ammonia rayon and the like. Alternatively, hemi-cellulose or low purity pulp containing some amount of lignin can also be used.

These cellulose starting materials can be used in the form of a pulp, cotton, cloth, paper, yarn, staple fibers and other optional forms.

The acetylating agent used for the acetylation reaction of the above-mentioned forms of fibrous cellulose can be either a vapor or a liquid. Depending on the physical state of the acetylating agent, the reaction is carried out in a solid-gas heterogeneous system or a solid-liquid heterogeneous system reaction wherein the starting cellulose is in the solid phase and the acetylating agent is in the other phase. In the case of the solid-liquid heterogeneous system reaction, those solvents or mixtures thereof which do not dissolve the resulting cellulose acetate can be used as the reaction medium. Examples of these solvents include trichloroethylene, benzene, toluene, xylene, kerosene and the like. As examples of the acetylating catalysts mention can be made of sulfuric acid, sulfoacetic acid, zinc chloride, perchloric acid, potassium acetate, sodium acetate and the like. The acetylating catalyst in the solid-gas heterogeneous system reaction is impreganted into, or supported on, the starting fibrous cellulose material.

As mentioned in the foregoing paragraphs, the form of the fibrous cellulose starting material and the resulting acetate fiber is not critically limited. Generally, however, a form having a larger surface area is more advantageous because it enhances the filtering efficiency. Accordingly, in addition to the known method of shaping a tobacco filter wherein the cellulose starting material is converted in advance into cellulose acetate by acetylation and then is shaped into a filter plug in a customary manner, various other methods can also be employed such as a method in which a pulp fiber sheet or crepe paper is first acetylated in the sheet form and then is wound to form a filter rod, or a method in which these materials already in the form of a filter rod are acetylated to provide a filter of cellulose acetate.

As examples of the other fibrous materials that can be used in admixture with the fibrous cellulose acetate fibers in the tobacco filters according to the present invention, mention can be made of cellulosic fiber materials such as pulp, cotton, jute, viscose rayon, cotton-ammonia rayon and various other natural and synthetic fiber materials such as wool, polyethylene terephthalate and polyvinyl such as wool, polyethylene terephthalate and polyvinyl alcohol.

As can be appreciated from the foregoing explanation, the present invention relates essentially to the use of the special heterogeneously acetylated fibrous cellulose acetate fiber as a component of the tobacco filter. In comparison with the filter made of the conventional homogeneously acetylated acetate fiber, the filter of the present invention affords a sufficiently low and smaller content of total particulate matter (hereinafter referred to as TPM) in the filtered tobacco smoke and exhibits high tar removal (a value obtained by subtracting the water content from the TPM) and nicotine removal. By using an especially small diameter cellulose fiber, it is also possible to enhance further the filtering efficiency.

In comparison with a filter prepared from a pulp fiber sheet or crepe paper, further, the filter of the present invention is more advantageous in that it does not spoil the original flavor and taste of the tobacco and it provides a superior roundness as well as cut shape of the mouthpiece. At the same time, the filter of the present invention is free from deformation due to moisture absorption during smoking. Because of these features, the filter of the present invention has higher utility than the conventional filters in general.

The production process for preparing the fibrous cellulose acetate fiber used in the present invention does not require such steps as dissolving, saponification, spinning and recovery of solvents. Hence, the present invention provides an advantageous method for the preparation of a tobacco filter in the aspects of savings of starting materials and energy as well as low cost of production.

Further, the starting cellulose fibrous material used for the preparation of the acetylated fibrous cellulose in the present invention is not necessarily limited to a high purity dissolved pulp (such as, for example, having an $\alpha$-cellulose content of 96%) which has generally been used for the preparation of cellulose acetate fibers. For example, relatively low purity pulps such as those used for papermaking can also be used in the present invention, thereby resulting in advantages from the viewpoint of natural resources.

In accordance with this invention, the average degree of acetylation of the cellulose fibers is preferred to be 10 to 50%, most preferably 25 to 45%. A tobacco filter comprising a fibrous cellulose acetate having an acetylation degree in this range is improved in the properties of maintaining the flavor of the tobacco smoke and minimizing deformation due to moisture absorption.

The terms "degree of acetylation" and "average degree of acetylation" used herein denote the degree of acetylation expressed in terms of the content of bonded acetic acid.

In order to satisfy the requirements of dry-spinning, the conventional homogeneously acetylated cellulose acetate fiber now in use is necessarily restricted to cellulose diacetate having a degree of acetylation such that it is soluble in a spinning solvent such as acetone. In other words, those having a degree of acetylation of 51 to 56% are generally used and this degree of acetylation can not be changed optionally.

In the case of the heterogeneously acetylated fibrous cellulose acetate fiber in accordance with the present invention, however, no dry-spinning is required at all so that the degree of acetylation can be varied over a wide range optionally. Accordingly, desirable filter characteristics can readily be obtained in order to improve the flavor and taste of the filtered tobacco smoke to the maximum extent.

The term "average degree of acetylation" used above in explaining the present invention is determined by saponifying a sample fiber by using caustic soda, in a heterogeneous system, and carrying out the back titration of the alkali consumed. The distribution of degree of acetylation is affected by the fine structure of the fiber and is believed to extend into molecular gaps as well as molecules per se in a wide range. In this respect, the concept of the term "average degree of acetylation" used herein is substantially different from the concept of "degree of acetylation" in the "homogeneously acetylated cellulose acetate" having a narrow range of distribution of degree of acetylation. For this reason, the present invention specifically makes a distinction between the two terms. For example, the "homogeneously acetylated cellulose acetate fiber" is perfectly soluble in acetone in the range of degree of acetylation of 51 to 56%, but the fibrous cellulose acetate fiber in accordance with the present invention is not completely soluble in acetone.

The present invention will be described in more detail with reference to the following illustrative Examples. In these examples, pressure drop, TPM and nicotine removal effect and packing quantity are measured in the following manner.

PRESSURE DROP

A filter and a U-shaped tube water-column meter are connected in parallel with each other to a vacuum pump for drawing air therethrough. The pressure drop is expressed in terms of the measurement shown by the water-column meter when the air stream is passing through the filter at a volumetric rate of 17.5 ml/sec during operation of the vacuum pump.

TPM & NICOTINE REMOVAL

Using a quantitative smoking device, a cigarette sample is smoked under the following conditions:

| | |
|---|---|
| smoking time | 2 seconds each time |
| interval between smoking times | 58 seconds |
| smoking length | 50 mm |
| smoke flow rate | 17.5 ml/sec. |

The main smoke is collected into three separate pieces by a Cambridge filter CM 113. The TPM and tar quantity are measured by a weight method while the nicotine quantity is measured by a ultraviolet absorption spectrum method. The removal is calculated by the following formula:

$$\text{Removal (\%)} = \frac{\text{Quantity collected in tobacco filter}}{\text{quantity collected in Cambridge filter} + \text{quantity collected in tobacco filter}} \times 100$$

FLAVOR AND TASTE

The flavor and taste are evaluated by assigning a rating based on the following criteria, wherein a rating of "6" indicates the best and "1" indicates the poorest flavor and taste.

| Flavor & Taste | Basis of Evaluation | Reference Material |
|---|---|---|
| 6 | Excellent tobacco taste with soft feeling but without pungent taste | |
| 5 | Good tobacco taste without pungent taste | "Cherry"* |
| 4 | Fair tobacco taste, though no pungent taste | "Wakaba"** |
| 3 | Slight pungent taste | |
| 2 | Pungent taste | |
| 1 | Pungent and bitter taste | |

*Commercially available Japanese cigarette with a homogeneously acetylated cellulose acetate filter.
**Commercially available Japanese cigarette with a pulp fiber sheet filter.

EXAMPLE 1

Fifty grams of shredded wood pulp ("Rayocord XP", a product of ITT Rayonier Inc., α-cellulose content of 96.1%) were dipped in 1,000 g of acetic acid at room temperature for one hour and then dehydrated to the weight 1.8 times as much as the pulp itself. The pulp was charged into a 2 liter flask, together with a mixture of 51.7 g of acetic anhydride and 1.0 g of sulfuric acid that had been heated at 95° C for 10 minutes, in the presence of 1147 g of toluene. With agitation, the mixture was reacted at 60° C for 1 hour. After the reaction, the liquid was removed and the solid residue was washed with water and methanol and then was dried thereby to yield a fibrous cellulose acetate fiber having an average degree of acetylation of 34.6%.

The fibrous cellulose acetate fiber (fiber length of 2–3 mm, diameter = 0.02 mm, corresponding to 2 denier) was rolled in rice paper to form a filter tip having an inner diameter of 7.9 mm and a length of 17 mm. The filter tip was then attached to a cigarette (which was obtained by removing the filter tip from a commercially available Japanese cigarette "Cherry").

As a control, the pressure drop, TPM, tar and nicotine removal and the packing quantity of the commercially available "Cherry" cigarette with its customary factory-made acetate filter were measured. The results are shown in Table 1 below.

Table 1

| | Pressure Drop (mm water-column) | TPM Removal (%) | Tar Removal (%) | Nicotine Removal (%) | Packing Quantity (g) |
|---|---|---|---|---|---|
| This invention | 60 | 54.2 | 59.4 | 46.5 | 0.09245 |

Table 1-continued

| | Pressure Drop (mm water-column) | TPM Removal (%) | Tar Removal (%) | Nicotine Removal (%) | Packing Quantity (g) |
|---|---|---|---|---|---|
| Control | 60 | 50.3 | 34.3 | 30.1 | 0.10915 |

It can be appreciated from the above table that the filter of the present invention using the fibrous cellulose acetate fiber, in a smaller packing quantity, exhibits a pressure drop similar to the currently available cellulose acetate filter and is superior to the latter in the TPM, tar and nicotine removal.

EXAMPLE 2

Seventeen grams of tissue-paper ("Kim Wipe", a product of Jujo-Kimbaley Co., α-cellulose content of 87.6%) was dipped into 340 g of acetic acid at room temperature for one hour and then dehydrated to the weight 1.5 times as much as the pulp itself. The pulp was charged into a 2 liter flask together with a mixture of 1856 g of trichloroethylene, 249 g of acetic anhydride and 2.1 g of sulfuric acid which had been heated at 95° C for 10 minutes. The mixture was reacted at 60° C for one hour while allowing only the liquid to circulate. After the reaction, the liquid was removed and the solid residue was washed with methanol and water and then dried thereby to yield a paper-like cellulose acetate having a degree of acetylation of 47.3%.

The cellulose acetate sheet was packed into rice paper to form a filter tip having an inner diameter of 7.9 mm and a length of 17 mm and the resulting filter tip was attached to a cigarette (which was obtained by removing a "pulp fiber sheet filter" from a commercially available Japanese cigarette "Wakaba").

As a control, the pressure drop, the TPM, tar and nicotine removal of the commercially available cigarette "Wakaba" equipped with the "pulp fiber sheet filter" as factory-made were measured. The results are shown in Table 2 below.

Table 2

| | Pressure drop (mm water-column) | TPM Removal (%) | Tar Removal (%) | Nicotine Removal (%) | Packing Quantity (g) |
|---|---|---|---|---|---|
| This invention | 50 | 50.5 | 52.3 | 38.0 | 0.09025 |
| Control | 50 | 50.1 | 43.3 | 30.6 | 0.11051 |

It can be appreciated clearly from the above table that the filter of the present invention, in a smaller packing quantity, exhibits a pressure drop similar to the currently available "pulp fiber sheet filter" and is superior to the latter in removal of all the listed substances.

EXAMPLE 3

Two grams of shredded wood pulp ("Hicolor XFLD") was dipped in 20% aqueous potassium acetate solution at 50° C for 30 minutes and then dehydrated to the weight 2.2 times as much as the pulp itself and was then dried at 80° C for 3 hours. The dried pulp was acetylated by a vapor of acetic anhydride maintained at 140° C for one hour, then washed with water and dried thereby to yield fibrous cellulose acetate fiber having a degree of acetylation of 35.2%.

The fibrous cellulose acetate fiber was packed into rice paper to form a filter tip having an inner diameter of 7.9 mm and a length of 17 mm, and the resulting filter was attached to a cigarette (which was obtained by removing the pulp fiber sheet filter tip from a commercially available cigarette "Wakaba").

As a control, shredded pulp ("Hicolor XFLD") was packed into rice paper to obtain a similar filter tip and the resulting filter was attached to a cigarette which was obtained by removing the "pulp fiber sheet filter" from a commercially available cigarette "Wakaba".

In comparison with the filter made of the shredded pulp, the filter using the fibrous cellulose acetate fiber of the present invention does not spoil the original flavor and taste of tobacco, it causes no deformation of the mouthpiece due to moisture absorption during smoking and it has a better elastic recovery to maintain its roundness.

EXAMPLE 4

Fifty grams of shredded wood pulp ("Hicolor XFLD", a product of I.T.T. Rayonier Inc., α-cellulose content of 93.9%) was dipped in 1,000 g of acetic acid at room temperature for one hour and then dehydrated to the weight 1.8 times as much as the pulp itself. The pulp was charged into a 2 liter flask together with a mixture of 1,240 g of toluene, 75.6 g of acetic anhydride and 1.84 g of sulfuric acid that had been heated at 95° C for 10 minutes. The mixture was reacted with stirring at 60° C for 80 minutes. After the reaction, the liquid was removed and the solid residue was washed with methanol and water and then dried thereby to yield a fibrous cellulose acetate fiber having an average degree of acetylation of 40.8%.

The fibrous cellulose acetate fiber (fiber length = 2–3 mm, diameter = 0.02 mm, corresponding to 2 denier) was charged into rice paper to form a filter tip having an inner diameter of 7.9 mm and a length of 17 mm, so that the air pressure drop of the filter tip was 60 mm water-column.

The tip was then attached to a cigarette (one obtained by removing the filter tip from a commercially available cigarette "Cherry") and was subjected to the flavor and taste test. The filter was evaluated as having the flavor and taste rating of the grade "6".

EXAMPLE 5

Fifty grams of shredded wood pulp ("Hicolor XFLD") was dipped in 1,000 g of acetic acid at room temperature for one hour and then dehydrated to the weight 1.8 times as much as the pulp itself. The pulp was charged into a 2 liter separable flask together with a mixture of 1,255 g of toluene, 56.7 g of acetic anhydride and 1.1 g of sulfuric acid that had been heated at 95° C for 10 minutes. The mixture was reacted with stirring at 60° C for one hour. After the reaction, the liquid was removed, and the solid residue was washed with methanol and water and then dried thereby to yield a fibrous cellulose acetate fiber having an average degree of acetylation of 31.4%.

The fibrous cellulose acetate fiber was charged into rice paper to obtain a filter tip having an inner diameter of 7.9 mm and a length of 17 mm so that the pressure drop of the filter tip was 50 mm water-column.

The tip was then attached to a cigarette (one obtained by removing the filter tip of a commercially available "Wakaba") and subjected to the flavor and taste test. The filter was evaluated as having the flavor and taste rating of the grade "5".

EXAMPLE 6

Fifty grams of shredded wood pulp ("Hicolor XFLD") was dipped in 1,000 g of acetic acid at room temperature for one hour and then dehydrated to the weight 1.8 times as much as the pulp itself. The pulp was charged into a 2 liter separable flask together with a mixture of 1,866 g of trichloroethylene, 245 g of acetic anhydride and 6.32 g of sulfuric acid that had been heated at 95° C for 10 minutes. The mixture was reacted with stirring at 40° C for 30 minutes. After the reaction, the liquid was removed, and the residue was washed with water and methanol and then dried thereby to yield a fibrous cellulose acetate fiber having an average degree of acetylation of 49.2%.

The fibrous cellulose acetate fiber was charged into rice paper to form a filter tip having an inner diameter of 7.9 mm and a length of 17 mm so that the pressure drop of the filter tip was 50 mm water-column.

The tip was then attached to a cigarette (one obtained by removing the filter tip from a commercially available "Wakaba") and subjected to the flavor and taste test. The filter is evaluated as having the flavor and taste rating of the grade "4".

EXAMPLE 7

Fifty grams of shredded wood pulp ("Hicolor XFLD") was dipped into 1,000 g of acetic acid at room temperature for one hour and then dehydrated to the weight 1.8 times as much as the pulp itself. The pulp was charged into a 2 liter separable flask together with a mixture of 1,283 g of toluene, 21.6 g of acetic anhydride and 0.74 g of sulfuric acid that had been heated at 95° C for 10 minutes. The mixture was reacted with stirring at 60° C for one hour. After the reaction, the liquid was removed, and the residue was washed with water and methanol and then dried thereby to yield a fibrous cellulose acetate fiber having an average degree of acetylation of 12.7%.

The fibrous cellulose acetate fiber was charged into rice paper to form a filter tip having an inner diameter of 7.9 mm and a length of 17 mm so that the pressure drop of the filter tip was 50 mm water-column.

The tip was then attached to a cigarette (one obtained by removing the filter tip from a commercially available "Wakaba") and subjected to the flavor and taste test. The filter was evaluated as having the flavor and taste rating of the grade "4".

EXAMPLE 8

Fifty grams of shredded wood pulp ("Rayocord XP", a product of ITT Rayonier Inc., α-cellulose content of 96.1%) was dipped in 1,000 g of sulfuric acid at room temperature for one hour and then dehydrated to the weight 1.8 times as much as the pulp itself. The pulp was charged into a 2 liter flask together with a mixture of 1,147 g of toluene, 51.8 g of acetic anhydride and 1.0 g of sulfuric acid that had been heated at 95° C for 10 minutes. The mixture was reacted with stirring at 60° C for one hour. After the reaction, the liquid was removed, and the residue was washed with water and methanol and then dried thereby to yield a fibrous cellulose acetate fiber having an average degree of acetylation of 34.6%.

The fibrous cellulose acetate fiber (fiber length = 2–3 mm) was charged into rice paper to form a filter tip having an inner diameter of 7.9 mm and a length of 17 mm.

The filter tip was then attached to a cigarette (one obtained by removing the filter tip from a commercially available "Cherry") and was subjected to the flavor and taste test. The filter was evaluated as having a flavor and taste rating of the grade "6".

EXAMPLE 9

Two grams of shredded wood pulp ("Hicolor XFLD") was dipped in 20% aqueous solution of potassium acetate at 50° C for 30 minutes, dehydrated to the weight 2.2 times as much as the pulp itself and then dried at 80° C for 3 hours. The pulp was acetylated in a vapor of acetic anhydride at 140° C for one hour, washed with water, then dried thereby to yield a fibrous cellulose acetate fiber having a degree of acetylation of 35.2%.

The fibrous cellulose acetate fiber was charged into rice paper to form a filter tip having an inner diameter of 7.9 mm and a length of 17 mm so that the pressure drop of the filter was 60 mm water-column.

The filter tip was attached to a cigarette (one obtained by removing the filter tip from a commercially available cigarette "Cherry") and subjected to the flavor and taste test. The filter was evaluated as having the flavor and taste rating of the grade "6".

COMPARATIVE EXAMPLE 1

Fifty grams of shredded wood pulp ("Hicolor XFLD") was dipped in 1,000 g of acetic acid at room temperature for one hour and then dehydrated to the weight 1.8 times as much as the pulp itself. The pulp was charged into a 2 liter separable flask together with a mixture of 1,866 g of trichloroethylene, 245 g of acetic anhydride and 6.32 g of sulfuric acid that had been heated at 95° C for 10 minutes. The mixture was reacted with stirring at 44° C for 4 hours. After the reaction, the liquid was removed, and the residue was washed with water and methanol and then dried thereby to yield a fibrous cellulose acetate fiber having an average degree of acetylation of 63%.

In exactly the same way as described in Example 5, the filter tip was prepared from this fibrous cellulose acetate fiber and subjected to the flavor and taste test. The filter was evaluated as having the flavor and taste rating of the grade "2".

COMPARATIVE EXAMPLE 2

The experiment was repeated in substantially the same way as described in Example 5 except that the filter tip was prepared from the shredded wood pulp ("Hicolor XFLD") in place of the fibrous cellulose acetate fiber. The resulting filter was evaluated as having the flavor and taste rating of the grade "1".

COMPARATIVE EXAMPLE 3

Fifty grams of shredded wood pulp ("High Color XFLD") was dipped into 1,000 g of acetic acid at room temperature for one hour and then dehydrated to the weight 1.8 times as much as the pulp itself. The pulp was charged into a 2 liter separable flask together with a mixture of 2,174 g of trichloroethylene, 16.2 g of acetic anhydride and 0.37 g of sulfuric acid that had been heated at 95° C for 10 minutes. The mixture was reacted with stirring at 20° C for 45 minutes. After the reaction, the liquid was removed, and the residue was washed with methanol and water and then dried thereby to yield a fibrous cellulose acetate fiber having an average degree of acetylation of 3.2%.

The fibrous cellulose acetate fiber was charged into rice paper to form a filter tip having an inner diameter of 7.9 mm and a length of 17 mm so that the pressure drop of the filter tip was 50 mm water-column. The filter tip was then attached to a cigarette (one obtained by removing the filter tip from a commercially available cigarette "Wakaba") and then subjected to the flavor and taste test. The filter was evaluated as having the flavor and taste rating of the grade "2".

The embodiments of the invention in which an exclusive property or privilege is claimed are defined as follows:

1. A tobacco filter comprising a mass of cellulose acetate fibers which are not completely soluble in acetone and which have been prepared by contacting cellulose fibers in the solid fibrous state, with a gaseous or liquid acetylating agent, under conditions effective to acetylate said cellulose fibers to an average degree of acetylation, calculated as combined acetic acid, of from 10 to 50 percent, while continuously maintaining said fibers in a solid fibrous state.

2. A tobacco filter according to claim 1 in which the cellulose acetate fibers have an average degree of acetylation, calculated as combined acetic acid, of from 25 to 45 percent.

3. A tobacco filter according to claim 1 in which said cellulosic fibers are selected from the group consisting of cellulosic pulp fibers, cotton, jute, viscose rayon fibers and copper-ammonia rayon fibers.

4. A tobacco filter according to claim 1 in which said acetylating agent is acetic anhydride vapor, and in which an acetylating catalyst is impregnated in said cellulose fibers.

5. A tobacco filter according to claim 1 in which said acetylating agent is a liquid acetic anhydride, and the contacting is carried out in the presence of an inert organic reaction medium that is a nonsolvent for cellulose acetate and an acetylation catalyst.

6. A tobacco filter according to claim 5, in which said reaction medium is selected form the group consisting of trichloroethylene, benzene, toluene, xylene and kerosene, and said acetylating catalyst is selected from the group consisting of sulfuric acid, sulfoacetic acid, zinc chloride, perchloric acid, potassium acetate and sodium acetate.

7. A tobacco filter according to claim 1 in the form of a cigarette filter.

8. A tobacco filter according to claim 1, in which the filter consists essentially of from 30 to 100 weight percent of said cellulose acetate fibers and the balance is one or more fibers different from said cellulose acetate fibers and selected from the group consisting of cellulosic pulp, cotton, jute, viscose rayon fibers, copper-ammonia rayon fibers, wool, polyethylene terephthalate. fibers and polyvinyl alcohol fibers.

* * * * *